United States Patent [19]

Kohl

[11] 4,319,468

[45] Mar. 16, 1982

[54] RASCHEL MACHINE

[75] Inventor: Karl Kohl, Obertshausen, Fed. Rep. of Germany

[73] Assignee: Sulzer Brothers Ltd., Winterthur, Switzerland

[21] Appl. No.: 157,058

[22] Filed: Jun. 6, 1980

[30] Foreign Application Priority Data

Jun. 15, 1979 [CH] Switzerland ..... 5612/79

[51] Int. Cl.[3] ..... D04B 23/00

[52] U.S. Cl. ..... 66/203; 66/207

[58] Field of Search ..... 66/203, 207, 204, 214, 66/84

[56] References Cited

U.S. PATENT DOCUMENTS 2,699,658 1/1955 Peters ..... 66/207

3,099,921 8/1963 Liebrandt ..... 66/214

3,512,378 5/1970 Bosse-Platiere ..... 66/84

*Primary Examiner*—Ronald Feldbaum

*Attorney, Agent, or Firm*—Kenyon & Kenyon

[57] ABSTRACT

The Raschel machine is comprised of a plurality of lapping belts and a yarn laying-in comb which penetrates the pattern yarns running to the latch needles. The comb moves substantially at right angles to the axis of the latch needles and carries out a combined stroke and oscillating motion. In addition, a plurality of stitch forming systems are provided on the opposite side of the lapping belts and laying-in comb from the plane of the latch needles. The guide bars of these systems oscillate at an angle to the pattern yarns and move in a circular orbit.

10 Claims, 8 Drawing Figures

23
23
25
26
22
22
39
38
37
13
40
21
24
5
13
30
6
12
29
31
3
46
4
34
41
28
42
47
27
45
31
44
43
32
35
33

RASCHEL MACHINE

This invention relates to a Raschel machine.

As is known, Raschel machines are generally constructed with latch needles, lapping belts or guide strips for directing pattern yarns to the latch needles and a laying-in comb for manipulating the pattern yarns about the needles. Generally, the laying-in comb is constructed with a plurality of sinkers and is reciprocable so as to penetrate the group of pattern yarns substantially at right angles to the axis of the latch needles while inserting a stitch yarn. In one known machine of this kind, for example as described in U.S. Pat. No. 3,512,378, a large number of guide bars 1 are disposed close to one another in groups and have yarn guides which cooperate with a laying-in comb in the form of a plurality of selectors or blades. The selectors which guide or deflect the yarns swing between the latch needles and the guide bars to guide or deflect the pattern yarns. During this time, the selectors brush the bottom edges of the guide bars at an end of a deflection edge. However, such a machine has a serious disadvantage in that only one stitch forming yarn system can be provided, for example in the form of a single guide bar with guides.

In order to overcome the disadvantage of the previously known Raschel machines, it has been suggested to use horizontally disposed slide needles. However, this so reduces the accessability of the knitting tools that the machine is often difficult and time-consuming to operate. It has also been suggested to use latch needles and sinkers which move only in a swinging direction. However, this means that a trace comb cannot be used. In addition, the pattern yarns cannot be drawn in to an appreciable extent since the space under the guide bars is completely blocked by the additional base guide bars in front and the laying-in sinkers at the back.

Accordingly, it is an object of the invention to provide a Raschel machine which is able to use a multiplicity of stitch forming yarns systems.

It is another object of the invention to provide a modified arrangement of the major components of a Raschel machine in order to produce attractive fabrics.

It is another object of the invention to provide a Raschel machine with a plurality of stitch systems without reducing the accessability of the machine.

It is another object of the invention to provide a Raschel machine with a plurality of stitch systems wherein a trace comb can be added without difficulty.

Briefly, the invention provides a Raschel machine which is comprised of a plurality of latch needles, a plurality of lapping belts, a yarn laying-in comb and a plurality of guide bars having needle guides thereon. The latch needles are mounted in the machine to carry out a reciprocating motion in a given plane while the lapping belts are spaced from the needles on one side of the plane, i.e. on a downstream side, for guiding pattern yarns to the needles. In addition, the laying-in comb is mounted on the same side of the plane of the latch needles as the lapping belts and carries out an orbital motion perpendicularly of the plane of the latch needles to penetrate between the pattern yarns. The guide bars with the needle guides serve to lay-in stitch yarns and are mounted on an opposite side of the plane of the latch needles from the lapping belts, i.e. on the upstream side, and oscillate at an angle to the pattern yarns.

In addition, a means is provided in the machine for moving the comb orbitally with a combined stroke and oscillating motion.

The Raschell machine is constructed so that a plurality of guide bars with guide needles thereon, i.e. stitch systems, can be provided without reducing the accessability of the machine when drawing in the pattern yarns. Further, a trace comb can be added without difficulty.

The Raschell machine may also be provided with a yarn guide between the lapping belts and the guide bars for deflecting the pattern yarns when the stitch yarns are layed-in.

The laying-in comb is constructed with a plurality of parallel sinkers each of which has a deflecting edge extending towards the plane of the latch needles and a yarn catch at a lower region of the deflecting edge. Each yarn catch serves to prevent the associated yarn from sliding over the deflecting edge during the downward motion of the laying-in comb when in engagement with the yarns. In addition, each sinker is provided with a yarn guide rod which is positioned so that the yarn catch is disposed below the guide rod.

These and other objects and advantages of the invention will become more apparent from the following detailed description and appended claims taken in conjunction with the accompanying drawings in which:

Figure 1:
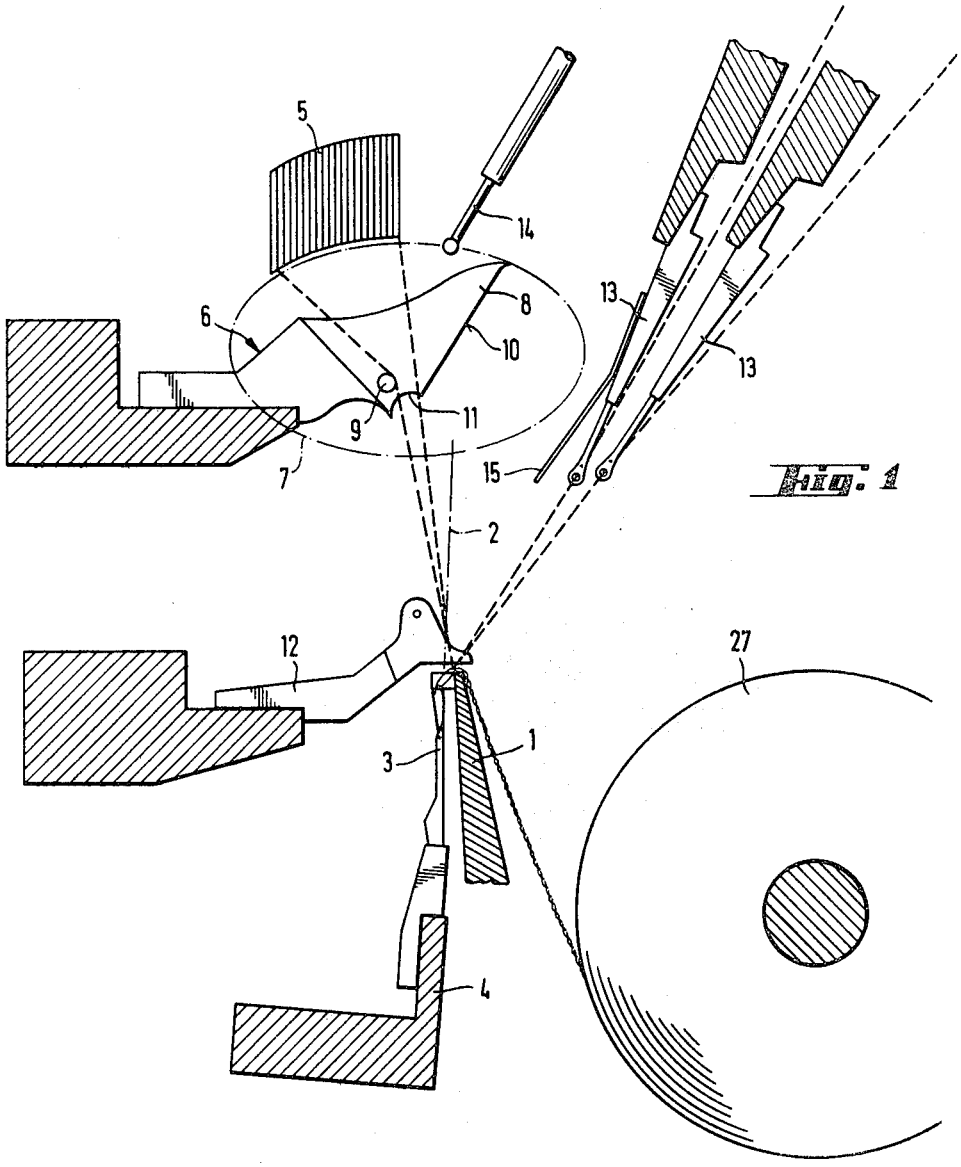
FIG. 1 illustrates a side view of a portion of a Raschel machine constructed in accordance with the invention.

Referring to FIG. 1, the Raschel machine is provided with a comb plate 1 in which a plurality of latch needles 3 are mounted for reciprocating motion along their axes 2 in a vertical plane, as viewed. As shown, the needles 3 are disposed on a bar 4 which is movable up and down.

In addition, the machine includes a plurality of lapping belts or guide bars 5 spaced from the needles 3 on one side, i.e. the downstream side, of the plane of the needles 3 for guiding pattern yarns to the needles 3. A yarn laying-in comb 6 is also mounted on the same side of the plane 2 of the latch needles 3 in order to carry out an orbital motion perpendicularly of the plane 2 while penetrating between the pattern yarns. As indicated in chain-dotted line 7, the orbital motion is a combined stroke and oscillating motion. The comb 6 is provided with a plurality of parallel sinkers 8 each of which carries a guide rod 9 and which has a deflecting edge 10 at the forward end extending towards the plane 2. In addition, each sinker 8 has a yarn catch 11 at a lower region of the deflecting edge 10 below the guide rod 9.

A trace comb 12 is also mounted over the comb plate 1 in known manner.

The machine also has a plurality of guide bars 13 which have needle guides thereon for directing stitch yarns to the latch needles 3. As shown, the guide bars 13 are mounted on the side of the plane 2 of the latch needles 3 opposite the lapping belts 5, i.e. on the upstream side. Suitable means are also provided for oscillating the guide bars 13 at an angle to the pattern yarns.

As shown in FIG. 1, the lapping belts 5 are positioned at an acute angle downstream of the plane 2.

A yarn guide 14 is also disposed between the belts 5 and the guide bars 13 for deflecting the pattern yarns upon laying-in of the stitch yarns. This yarn guide 14 is used for laying the pattern yarns in the needle lanes (not shown). The yarn guide 14 may be coupled to the guide bars 13 so as to move therewith or may be provided with an independent drive (not shown).

A second yarn guide 15 is disposed downstream of the movable guide bars 13 and serves to deflect the pattern yarns when the stitch yarns are laid in. This yarn guide 15 maybe mounted, on the rearmost guide bars 13, as viewed.

The operation of the Raschel machine will be described with reference to FIGS. 1 to 7.

As shown in FIG. 1, the machine is in the position in which the old stitches are cast off. As indicated, the laying-in comb 6 has passed by the lapping belts 5 and the yarn guide 14 and the various pattern yarns are disposed at the bottom end of the deflecting edge within the yarn catch 11. Depending upon the position of the pattern yarn, the yarn may be spaced in front of the respective guide rod 9 or deflected over the guide rod 9. Thereafter, the latch needles 3 move upwardly and the holding down process follows as in FIG. 2.

Figure 2:
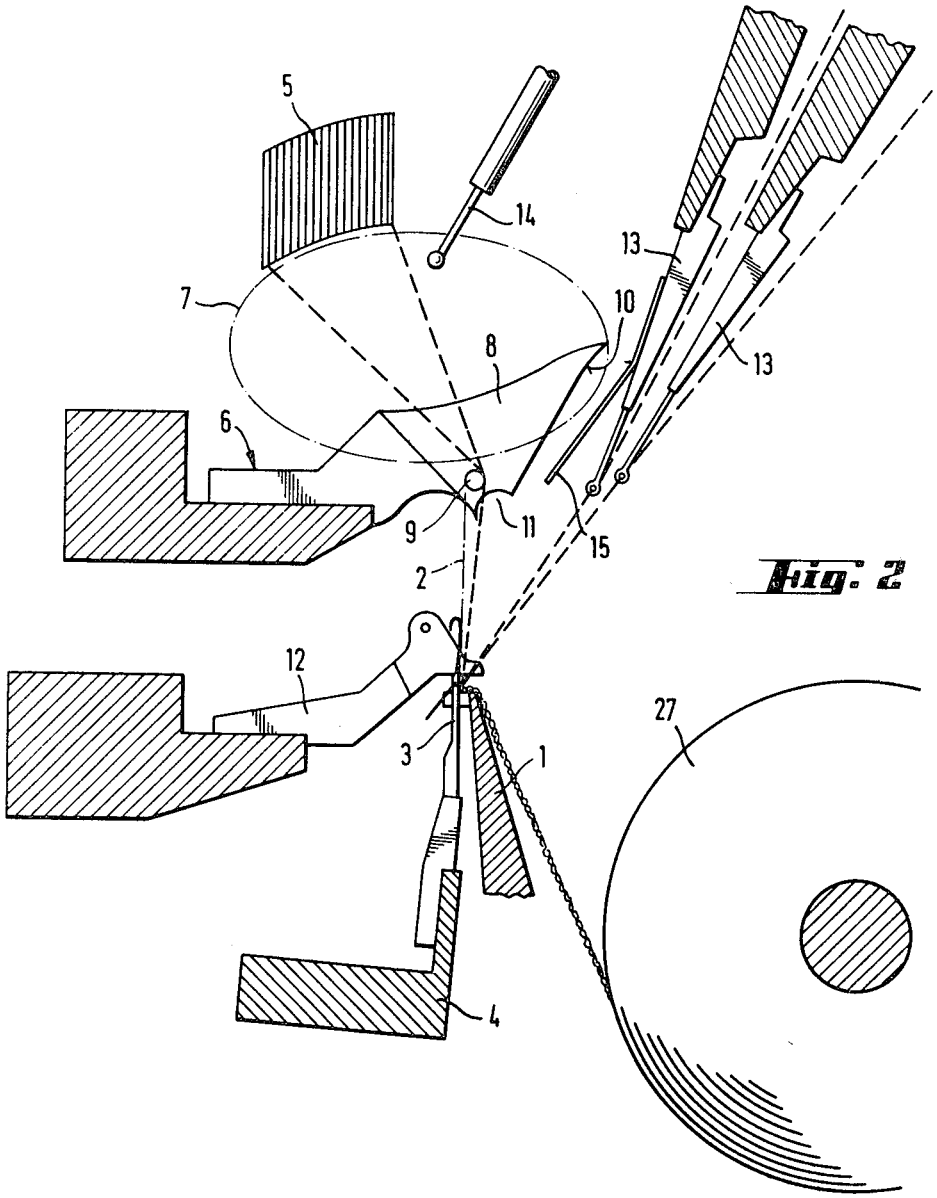
FIGS. 2 to 7 illustrate similar views to FIG. 1 at various sequential states of a stitch forming process in accordance with the invention.

As shown in FIG. 2, the laying-in comb has progressed along the orbital path 7 such that all of the pattern yarns are deflected about the respective guide rods 9. At this time, the comb has projected through the vertical plane 2 of the latch needles 3 and is at the maximum point of stroke relative to the plane 2.

Figure 3:
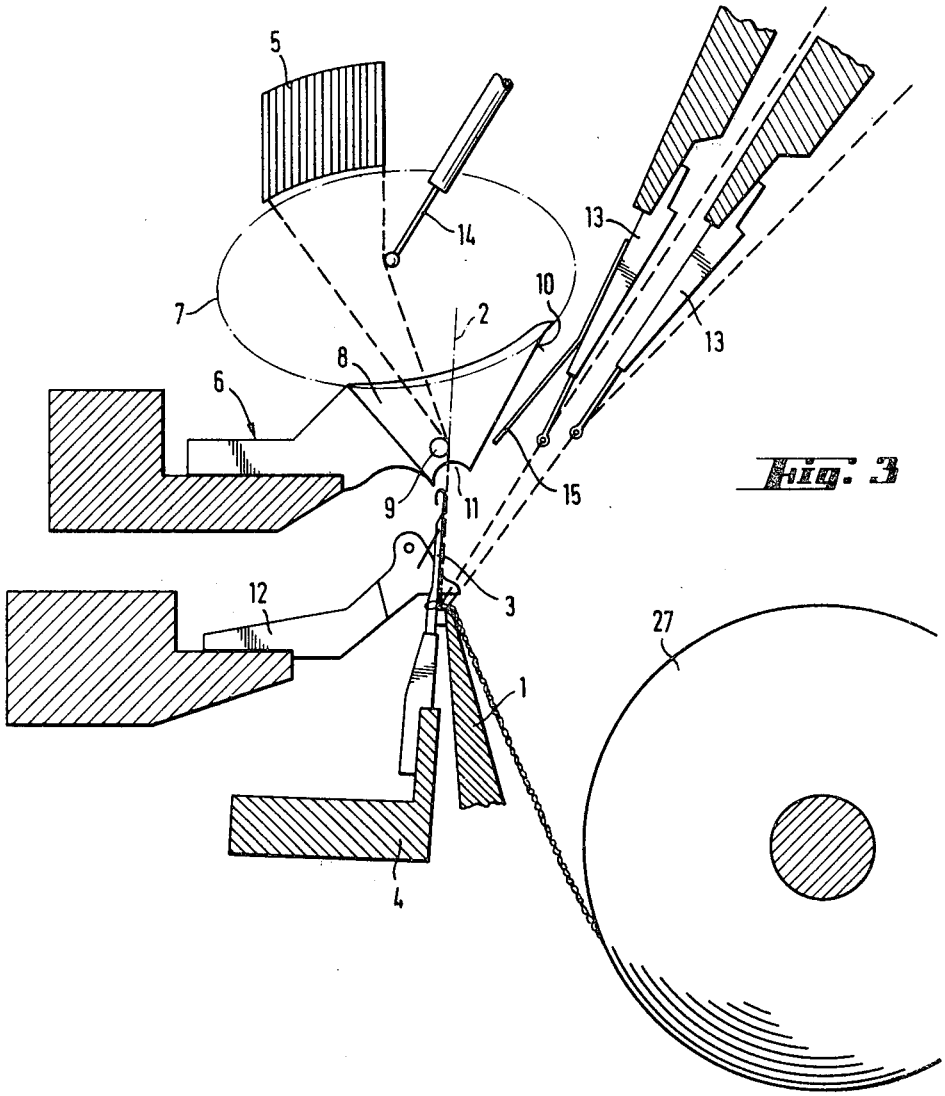
Figure 4:
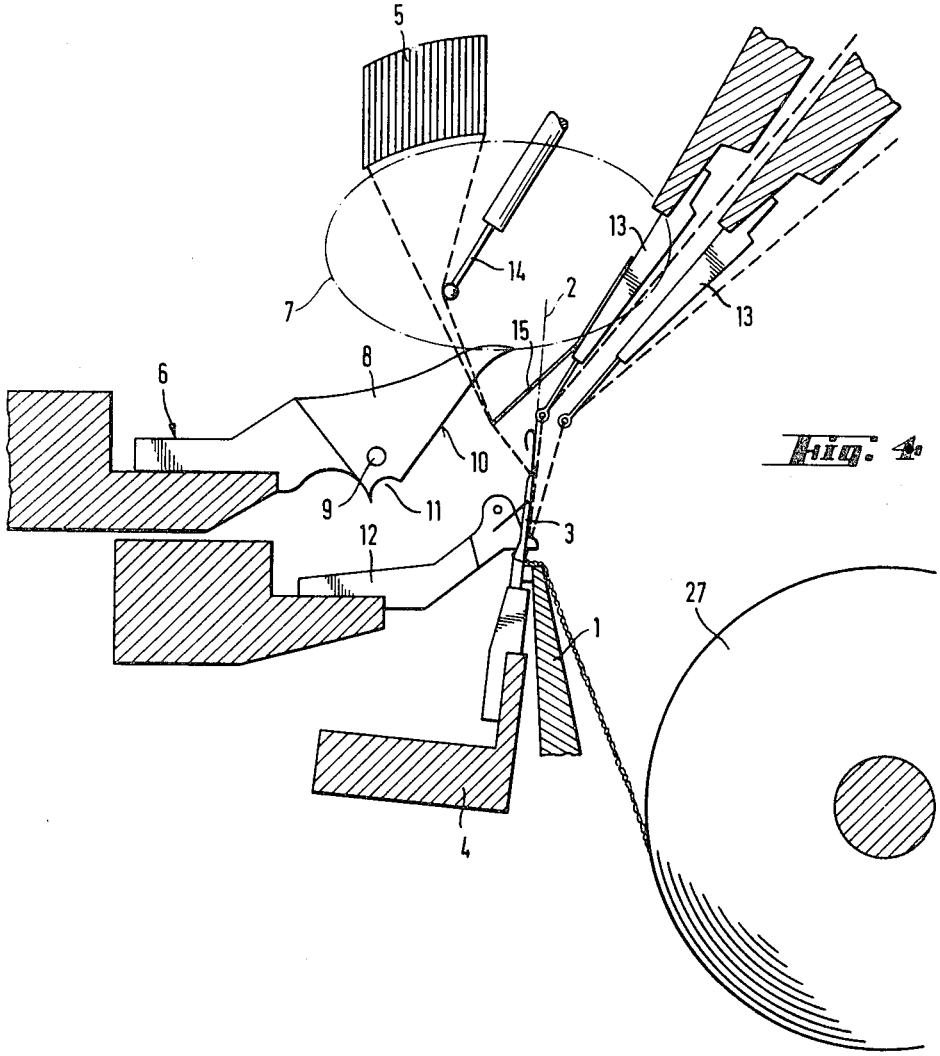

Thereafter, as shown in FIG. 3, as the laying-in comb 6 begins a return motion, the pattern yarns are laid in using the yarn guide 14. Next, as shown in FIG. 4 the pattern yarns are deflected by the yarn guide 14 and by the yarn guide 15 so that the stitch yarns can be laid-in by the guide bars 13 when the needles 3 have moved upwards.

Figure 5:
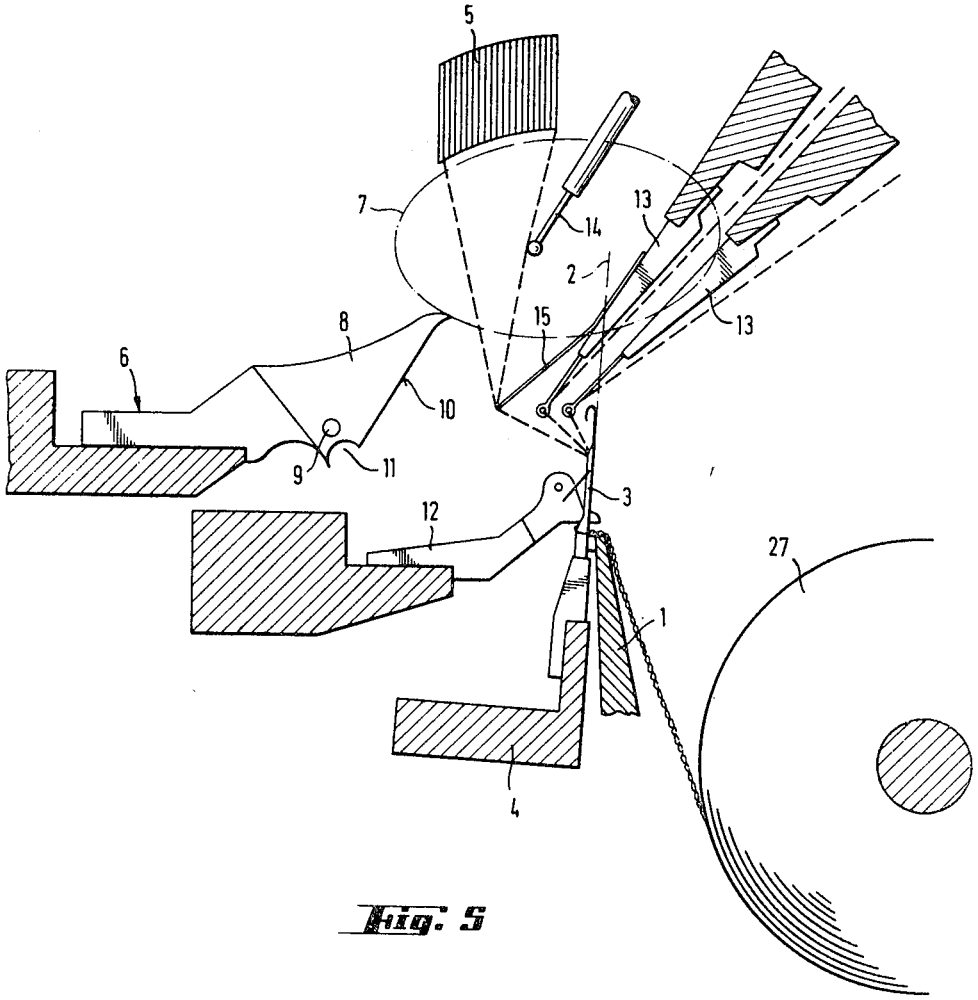

Referring to FIG. 5, as the laying-in comb continues to recede, the guide bars 13 continue a downward motion and an overlap occurs for stitch formation. At this time, the yarn guide 15 is also in a deflecting position.

Figure 6:
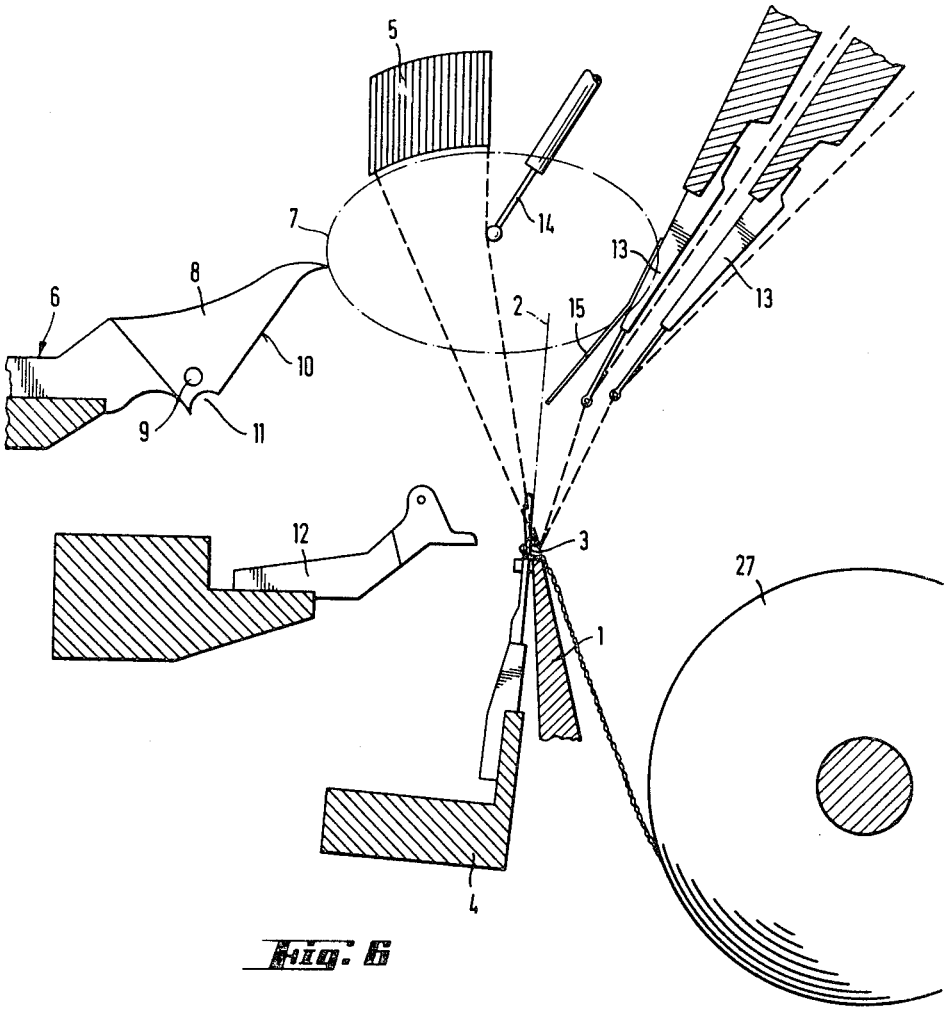
Figure 7:
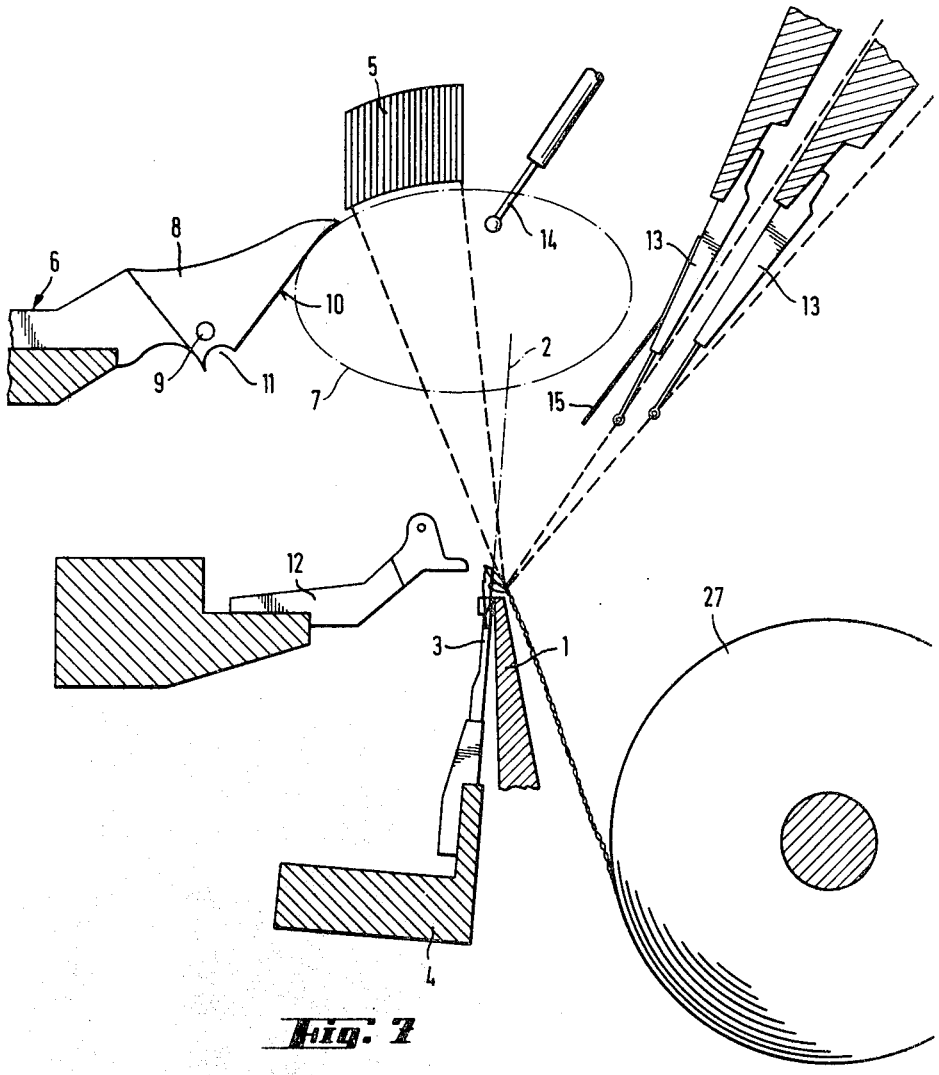

Referring to FIG. 6, the stitch loops are then landed and, as shown in FIG. 7, are drawn through for casting off. During this time, the laying-in comb has passed its rearmost point and has begun a forward motion. At the same time, the guide bars 13 carry out a return stroke.

Likewise, the yarn guide 14 carries out a return stroke.

Figure 8:
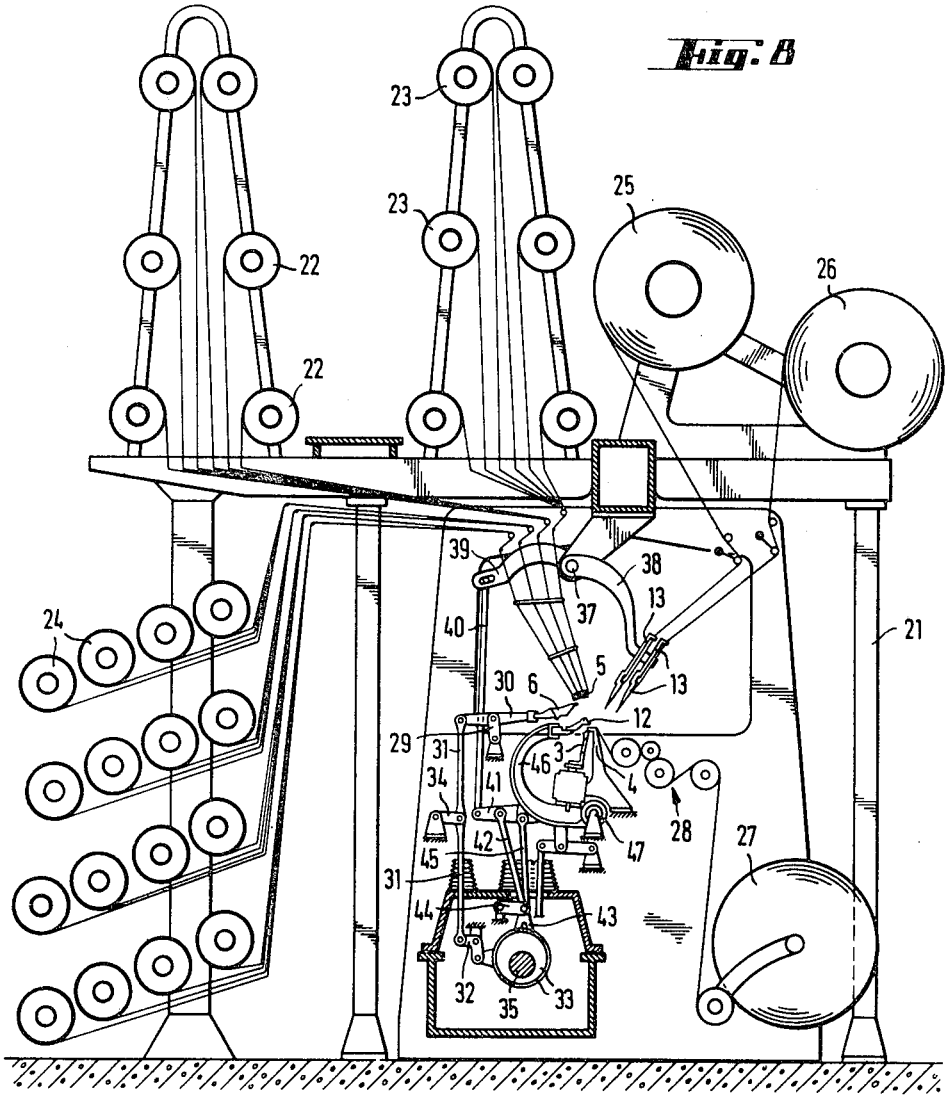
FIG. 8 illustrates a side view of the Raschel machine illustrating various means for driving the components for forming stitches and patterns.

Referring to FIG. 8, the Raschel machine comprises a frame 21 on which a plurality of pattern beams 22, 23, 24 for the pattern yarns are carried along with beams 25, 26 for the stitch yarns and weft yarns and a cloth beam 27 for taking-up the formed cloth via a group of rollers 28. For simplicity, the group of yarns only as far as the lapping belts 5 and guide bars 13 are shown.

A means for moving the laying-in comb 6 orbitally includes a lever 30 secured to the comb 6 and suspended on links 29. In addition, the free end of the lever 30 is connected by a rod and toggle lever 32 to an eccentric device 33. The rod 31 is also coupled to a further suspension link 34 and the eccentric device 33 is driven by a shaft 35 of the machine. This means operates off the shaft 35 so that the end of the laying-in comb 6 describes the curve shown in FIGS. 1–7.

The eccentric device 33 also drives the guide bars 13. To this end, the guide bars 13 are secured to the end of a locking lever 38 mounted on a shaft 37. The lever 38 has a continuation 39, the end of which is connected by a rod 40 to a lever 41 which is mounted on a stationary shaft 47 which extends along the length of the machine. The lever 41 is also connected by a rod 42 to a lug 43 which is secured to the eccentric device 33 and which is pivoted to a suspension link 44. When the shaft 35 rotates, the guide bars 13 are caused to move in a circle.

The trace comb 12 is mounted on levers 46 which are pivoted on the stationary shaft 47 and which are connected via rods 45 to the eccentric device 33.

The lapping belts 5 are mounted with a suitable means for imparting a shogging motion to the belts 5 in known manner, for example by means of a pattern-forming device described in German Auslegeschrift 26 10 888.

It is to be noted that other means can also be used for driving the stitch forming or pattern forming components of the Raschel machine.

The invention thus provides a Raschel machine with a plurality of stitch-forming yarn systems, i.e. guide bars 13. As a result, more intricate patterns can be produced in the final product.

What is claimed is:

1. A Raschel machine comprising a plurality of latch needles mounted for reciprocating motion in a given plane;

a plurality of lapping belts spaced from said needles on one said of said plane for guiding pattern yarns to said needles;

a yarn laying-in comb mounted on said one side of said plane for orbital motion perpendicularly of said plane to penetrate between the pattern yarns; and a plurality of guide bars having needle guides thereon for laying-in stitch yarns, said guide bars being mounted on an opposite side of said plane to oscillate at an angle to the pattern yarns.

2. A Raschel machine as set forth in claim 1 wherein said orbital motion is a combined stroke and oscillating motion.

3. A Raschel machine as set forth in claim 1 wherein said lapping belts are disposed at an acute angle downstream of said plane.

4. A Raschel machine as set forth in claim 1 which further comprises a yarn guide disposed between said belts and said guide bars for deflecting the pattern yarns upon laying-in of the stitch yarns.

5. A Raschel machine as set forth in claim 4 which further comprises a yarn guide mounted on said needle guides for deflecting the pattern yarns upon movement of said guide bars towards said plane.

6. A Raschel machine as set forth in claim 1 which further comprises a yarn guide mounted on said needle guides for deflecting the pattern yarns upon movement of said guide bars towards said plane.

7. A Raschel machine as set forth in claim 1 wherein said comb has a plurality of parallel sinkers, each said sinker having a deflecting edge extending towards said plane and a yarn catch at a lower region of said deflecting edge.

8. A Raschel machine as set forth in claim 7 wherein each sinker has a yarn guide rod and said yarn catch is disposed below said guide rod.

9. A Raschel machine as set forth in claim 1 wherein said plane is vertical and said belts are disposed above said needles.

10. A Raschel machine as set forth in claim 1 which further comprises means for moving said comb orbitally with a combined stroke and oscillating motion.

* * * * *